US006696647B2

(12) United States Patent
Ono et al.

(10) Patent No.: US 6,696,647 B2
(45) Date of Patent: Feb. 24, 2004

(54) COAXIAL CABLE AND COAXIAL MULTICORE CABLE

(75) Inventors: Nobuki Ono, Tokyo (JP); Hiroyuki Ito, Tokyo (JP); Fumio Shimizu, Tokyo (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 10/153,222

(22) Filed: May 23, 2002

(65) Prior Publication Data

US 2003/0168240 A1 Sep. 11, 2003

(30) Foreign Application Priority Data

Mar. 5, 2002 (JP) ..... 2002-058800

(51) Int. Cl.[7] ..... H01B 7/18; H01B 7/34

(52) U.S. Cl. ..... 174/102 R; 174/106 R; 174/36

(58) Field of Search ..... 174/102 R, 106 R, 174/110 R, 113 R, 109 R, 108, 36, 28, 126.1, 126.2; 333/243, 246

(56) References Cited

U.S. PATENT DOCUMENTS

| | | | | |
|---|---|---|---|---|
| 3,639,674 A | | 2/1972 | Stier | 174/36 |
| 3,973,227 A | | 8/1976 | Erculiani | 333/246 |
| 4,847,448 A | * | 7/1989 | Sato | 174/103 |
| 4,970,352 A | * | 11/1990 | Satoh | 174/106 R |
| 5,208,426 A | | 5/1993 | Kennedy et al. | 174/36 |
| 5,574,260 A | | 11/1996 | Broomall et al. | 174/102 R |
| 6,246,006 B1 | * | 6/2001 | Hardin et al. | 174/106 R |
| 2002/0142684 A1 | | 10/2002 | Miska | 442/63 |

FOREIGN PATENT DOCUMENTS

| | | | |
|---|---|---|---|
| JP | 6-187847 | 7/1994 | H01B/11/18 |
| JP | 0 675 507 A2 | 3/1995 | H01B/7/00 |
| JP | 11-224547 | 2/1998 | H01B/11/18 |
| JP | 2000-21250 A | 1/2000 | H01B/11/18 |

* cited by examiner

*Primary Examiner*—William H. Mayo, III
(74) *Attorney, Agent, or Firm*—Antonelli, Terry, Stout & Kraus, LLP

(57) ABSTRACT

A coaxial cable includes an inner conductor and an insulation covering the inner conductor. A plastic tape, with a tape body and a metal layer, is provided on the insulation. An outer conductor is provided on the plastic tape and a jacket is provided on the outer conductor. The metal layer includes a first metal layer formed on the tape body by vapor deposition and a second metal layer formed on the first metal layer by electroplating.

6 Claims, 4 Drawing Sheets

COAXIAL CABLE AND COAXIAL MULTICORE CABLE

BACKGROUND OF THE INVENTION

1. Field of the Invention

The invention relates to a coaxial cable which is widely used in an information communication field and particularly to a fine-diameter coaxial cable, with an outer diameter of an insulation of not more than 1 mm, adapted for the transmission of high frequency signals, and a coaxial multicore cable using the same.

2. Description of Related Art

For example, as shown in FIG. 1A, a conventional coaxial cable has a structure comprising: an inner conductor a, an insulation b, formed of polyethylene or the like, covering the circumference of the inner conductor a; an outer conductor c, formed of a braided metal or the like, provided on the circumference of the insulation b; and an insulating jacket d covering the circumference of the outer conductor c. In general, in the so-called "low-attenuation coaxial cable" used at a high frequency of 1 GHz to 10 GHz, as shown in this drawing, a plastic tape e with a metal layer is lengthwise attached to or wound around the circumference of the insulation b from the viewpoint of improving electric characteristics such as shield effect and attenuation level.

As shown in FIG. 1B, the construction of the plastic tape e with a metal layer is generally such that a metal foil g such as copper, aluminum, or silver is bonded to the surface of a plastic tape body f formed of a polyester, Teflon (registered trademark) or the like. When the metal foil g is formed of copper, the thickness is generally not less than 8 $\mu$m, i.e., is larger than the thickness of the metal foil g formed of aluminum or silver which is 4 $\mu$m.

In winding the conventional plastic tape e, with a metal layer, on the insulation b, when the insulation b is thick, no particular problem occurs. On the other hand, when the insulation b is very thin, for example, when the outer diameter is small and is not more than 1 mm, the winding work becomes very difficult and, in addition, after winding, a gap is formed between the plastic tape e and the insulation b, often leading to a deterioration in electric characteristics. Further, since the adhesion between the metal foil g and the tape body f is so small that, upon the application of external force, for example, as a result of flexure of the cable or friction against the outer conductor c, in the worst case, the metal foil g is separated from the tape body f. In particular, this phenomenon is significant when a highly flexible braided material is adopted as the outer conductor c.

To overcome this problem, when winding of the plastic tape on an insulation b having a small outer diameter of not more than 1 mm is contemplated, in order to form a relatively flexible plastic tape e with a metal layer, the formation of a metal layer on a tape body f by vapor deposition has also been proposed (for example, Japanese Patent Laid-Open No. 232611/1989 corresponding to U.S. Pat. No. 4,970,352). When this metal layer is formed by vapor deposition, however, the upper limit of the thickness of the metal layer is generally about 0.1 to 0.3 $\mu$m in the case of copper and about 0.05 to 0.5 $\mu$m in the case of aluminum. These thicknesses are unsatisfactory for providing desired electric characteristics.

Specifically, in order to attain satisfactory skin effect by a metal layer formed of copper or silver, a thickness of at least 2 $\mu$m is required for a high frequency of 1 GHz, and a thickness of at least 1 $\mu$m is required for a high frequency of 5 GHz. The vapor deposition method, however, cannot realize increased metal layer thickness without difficulty and thus disadvantageously cannot provide satisfactory electric characteristics.

SUMMARY OF THE INVENTION

Accordingly, the invention has been made with a view to solving the above problems of the prior art, and it is an object of the invention to provide a coaxial cable and a coaxial multicore cable which can effectively avoid the deterioration in electric characteristics attributable to the plastic tape with a metal layer.

According to the first feature of the invention, a coaxial cable comprising: an inner conductor; an insulation covering the inner conductor; a plastic tape, with a metal layer, provided on the insulation; an outer conductor provided on the plastic tape with a metal layer; and a jacket provided on the outer conductor, wherein the plastic tape with a metal layer comprises a tape body and, provided as the metal layer on the surface of the tape body in the following order, a first metal layer and a second metal layer formed of electroplating.

According to this construction, the thickness of the metal layer can be at least brought to a desired one, and, thus the deterioration in electric characteristics attributable to the plastic tape with a metal layer can be effectively avoided. Further, the tape per se can maintain the relatively flexible state. Therefore, even when the outer diameter of the insulation is as small as not more than 1 mm, the plastic tape with a metal layer can be easily and surely attached lengthwise to or wound around the circumference of the insulation. In addition, the adhesion between the metal layer and the tape can be improved. By virtue of this unfavorable phenomena such as separation of the metal layer can be prevented.

More specifically, when the first metal layer is formed by vapor deposition of a metal, the adhesion between the second metal layer formed of electroplating and the tape body can be improved. Further, when the thickness of the metal layer in the plastic tape with a metal layer is brought to more than 1 $\mu$m and not more than 4 $\mu$m, an increase in hardness of the tape can be surely avoided while enjoying satisfactory electric characteristics.

The adoption of a construction, wherein the plastic tape with a metal layer is provided so that the surface of the metal layer is in contact with the outer conductor, or a construction, wherein the plastic tape with a metal layer is constructed so that the metal layer is provided on both sides of the tape body can prevent unfavorable phenomena such as the separation of the metal layer from the tape body, even when the outer conductor is formed of a braided material, i.e., has concaves and convexes in a network form on its surface.

According to the second feature of the invention, a coaxial multicore cable comprises: a plurality of coaxial cables of any one of the above types, which have been twisted together; and, integrated with the coaxial cables, a sheath covering the circumference of the plurality of twisted coaxial cables.

This coaxial multicore cable possesses excellent electric characteristics and can be easily produced.

Coaxial cables, to which the invention is applied, preferably have an inner conductor size of 40 to 28 AWG (outer diameter: about 0.08 to 0.32 mm).

BRIEF DESCRIPTION OF THE DRAWINGS

The invention will be explained in more detail in conjunction with the appended drawings, wherein:

FIGS. 1A and 1B are enlarged cross-sectional views of a conventional coaxial cable, wherein FIG. 1A represents an example of the conventional coaxial cable and FIG. 1B represents an example of a plastic tape with a metal layer shown in FIG. 1A;

DESCRIPTION OF THE PREFERRED EMBODIMENTS

A preferred embodiment of the invention will be explained in conjunction with the accompanying drawings.

Figure 2:
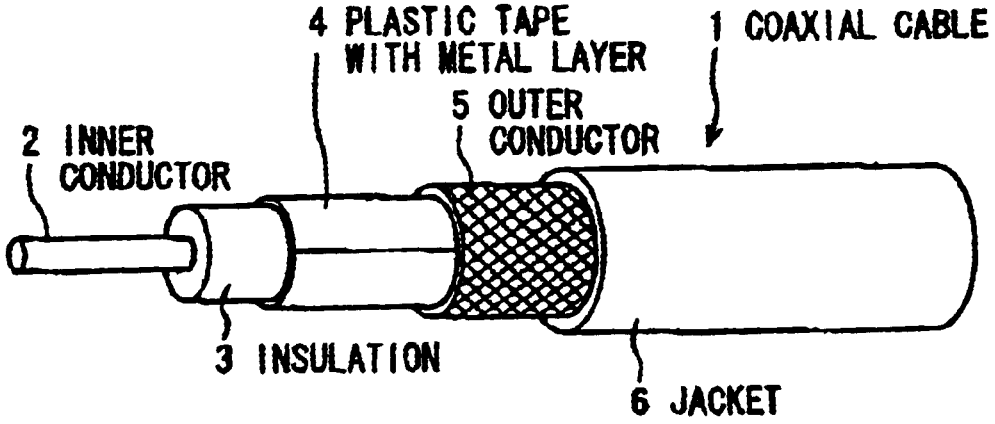
FIG. 2 is a perspective view showing a preferred embodiment of a coaxial cable according to the invention.

FIG. 2 is a perspective view showing a preferred embodiment of a coaxial cable 1 according to the invention.

As shown in the drawing, this coaxial cable 1 has a structure comprising: an inner conductor 2 formed of a copper wire or the like; an insulation 3 covering the surface of the inner conductor 2; a plastic tape 4, with a metal layer, wound on the insulation 3; and, provided on the plastic tape 4 with a metal layer in the following order, an outer conductor 5 formed of a braided metal and a jacket 6 formed of an insulating material.

Figure 3A:
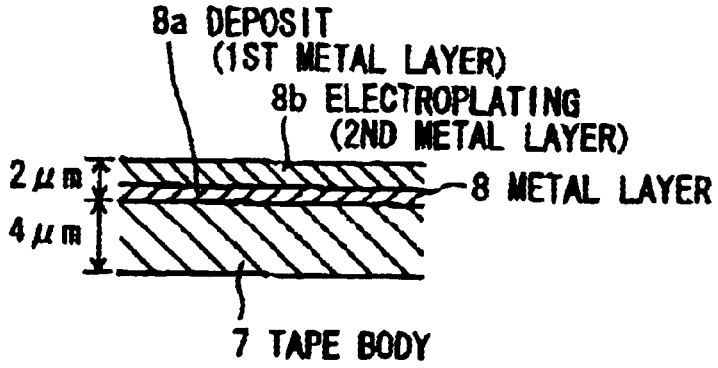
FIGS. 3A and 3B are enlarged cross-sectional views of a preferred embodiment of a plastic tape with a metal layer adopted in the invention.

In the coaxial cable 1 according to the invention, as shown in FIG. 3A, the construction of the plastic tape 4 with a metal layer is such that an about 2 μm-thick metal layer 8 is provided on the surface of an about 4 μm-thick tape body 7 formed of plastic. The metal layer 8 comprises a deposit (a first metal layer) 8*a*, which has been formed by vapor deposition of a metal directly on the tape body 7, and an electroplating (a second metal layer) 8*b* which has been formed by electroplating onto the deposit 8*a*.

The thickness of the metal layer 8 provided on the tape body 7 is more than 1 μm and not more than 4 μm and is preferably in the range of 1.5 to 4 μm. Specifically, a thickness of not more than 1 μm is unsatisfactory for providing satisfactory electric characteristics. On the other hand, when the thickness exceeds 4 μm, the whole tape 4 is hard and this makes it difficult to perform the attachment of the tape lengthwise to or winding of the tape around the circumference of an insulation 3 having a small outer diameter of about 1 mm. This metal layer 8 may be formed of any metal without particular limitation so far as the metal has an electrical conductivity of not less than 90% IACS and can be vapor deposited and is suited for plating. Preferred are copper and silver.

The whole thickness of the plastic tape 4 with the metal layer 8 is preferably not more than 15 μm. When the thickness is more than 15 μm, it is difficult to perform the attachment of the tape lengthwise to or winding of the tape around the circumference of an insulation 3 having a small outer diameter of not more than 1 mm. By virtue of this construction, unlike the prior art technique using the metal foil g, the tape per se does not become hard and can be kept flexible and, thus, can be easily and surely wound even around an insulation 3 having a small diameter of not more than 1 mm. The thickness of the tape body 7 is preferably twice or more the thickness of the metal layer 8 from the viewpoint of the necessity of ensuring a certain level of strength, for example, for lengthwise attachment to or winding around the insulation 3. Specifically the thickness should be at least 2 μm. As with the tape body used in the prior art technique, the tape body 7 may be formed of a conventional plastic such as polyester or Teflon (registered trademark).

In the plastic tape 4 with the metal layer having the above structure, as described above, the metal layer 8 has a two-layer structure which comprises a deposit 8*a*, which has been formed by vapor deposition of a metal directly on the tape body 7, and an electroplating 8*b* which has been formed by electroplating onto the deposit 8*a*. By virtue of this construction, since the metal layer 8 is intimately adhered to the tape body 7 side, there is no problem, for example, that the metal layer B is separated from the tape body 7 after the tape is attached lengthwise to or is wound on the insulation 3. Further, since the metal layer 8 has a satisfactory thickness, satisfactory electric characteristics can be provided. In particular, when a braided metal is used as the outer conductor 5, the surface thereof has concaves and convexes in a network form and, thus, the above effect is more significant.

More specifically, as described above, the formation of a layer 8*a* by vapor deposition of the metal only cannot provide a satisfactory thick metal layer without difficulty. Since, however, the deposit 8*a* formed by vapor deposition of the metal has good adhesion to plastics and further has good adhesion to another metal, an electroplating 8*b* can be surely formed on the deposit 8*a* and a satisfactory thickness can be ensured by the electroplating 8*b*.

The deposit 8*a* as the first metal layer is formed by vacuum deposition. Alternatively, other methods such as sputtering may be adopted for the formation of the first metal layer so far as good adhesion to the tape body 7 can be realized.

Figure 3B:
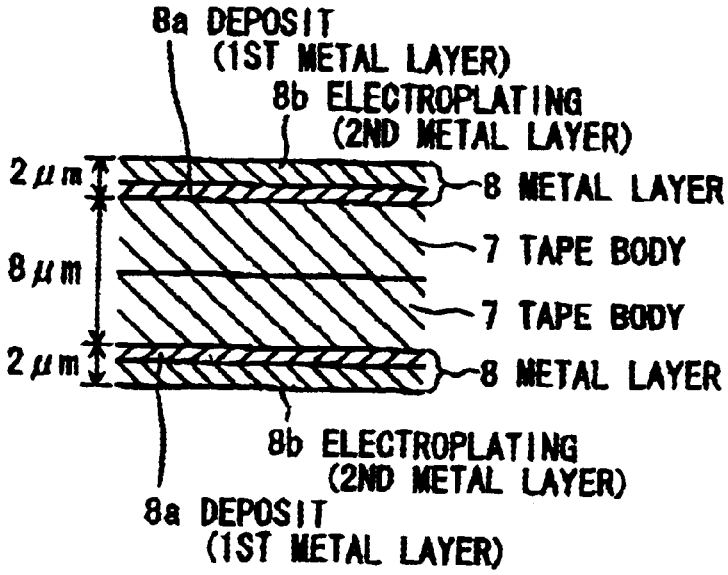

Further, as shown in FIG. 3B, a construction may be adopted wherein two tape bodies 7 are put on top of each other and bonded to each other, and metal layers 8,8 of the above type are provided respectively on the upper and lower tape bodies 7.

Figure 4:
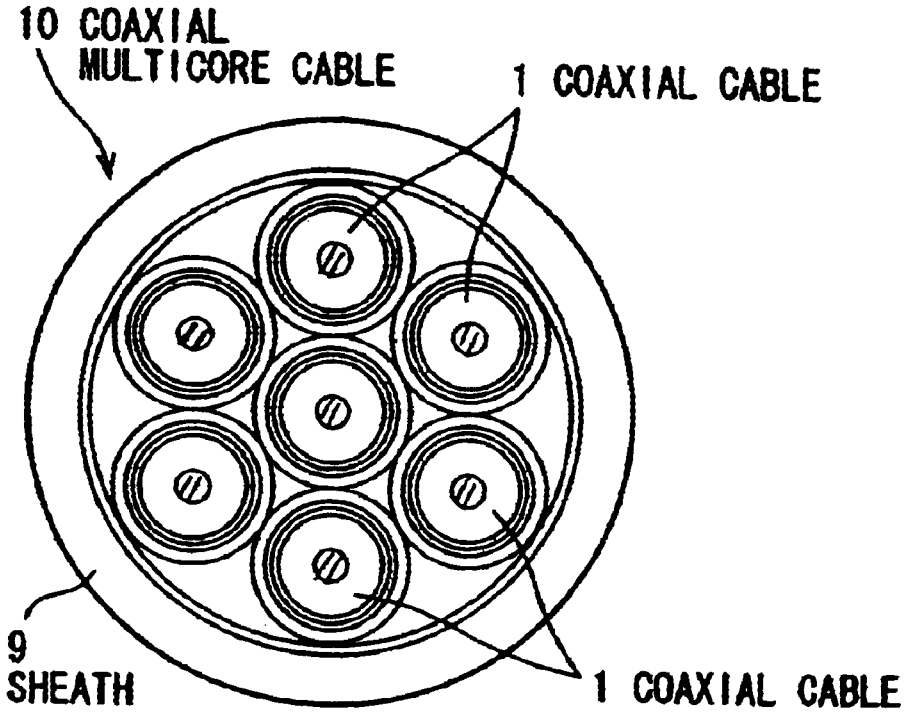
FIG. 4 is a perspective view showing a preferred embodiment of a coaxial multicore cable according to the invention.

Further, as shown in FIG. 4, a coaxial multicore cable 10 having excellent electric characteristics can be easily produced by twisting a plurality of coaxial cables 1 of the above type (7 coaxial cables in this preferred embodiment) together and covering the circumference of the twisted coaxial cables integrally with a sheath 9.

EXAMPLES

The following examples further illustrate the invention.

Example 1

Figure 1A:
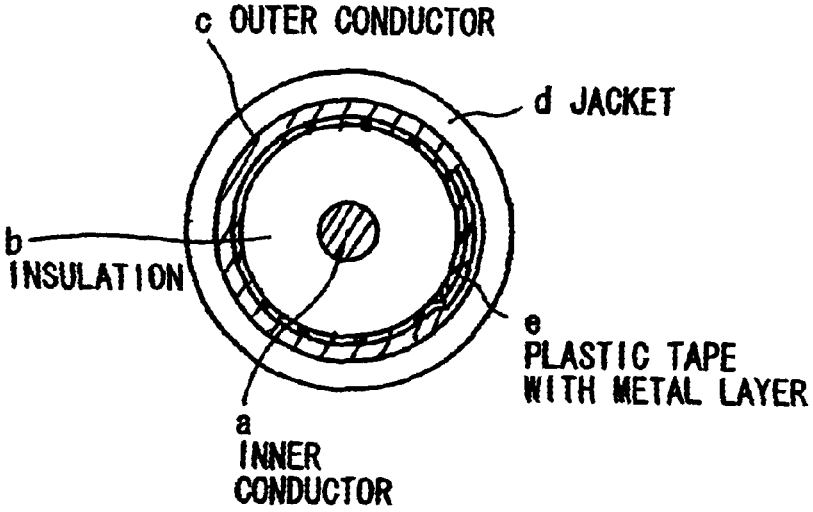
FIG. 1A PRIOR ART
Figure 1B:
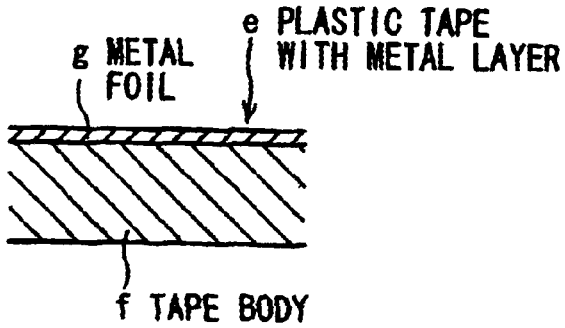
FIG. 1B PRIOR ART

A silver-plated annealed copper wire of 32 AWG (outer diameter: about 0.24 mm) was provided as an inner conductor 2 in the coaxial cable 1 as shown in FIG. 1. FEP (ethylene tetrafluoride/propylene hexafluoride copolymer) resin was extruded on the inner conductor 2 to form an FEP resin insulation as an insulation 3. Thus, an insulated core wire with the outer diameter of the insulation being 0.68 mm was prepared. A plastic tape 4, with a metal layer, having a structure as shown in FIG. 3A was tubularly attached lengthwise thereonto so that the metal layer 8 side faced outward. Further, a braided product of a tin-plated annealed copper wire having a diameter of 0.05 mm was applied onto the metal layer 8 to form an outer conductor 5. The outer conductor 5 was then covered with FEP as a jacket 6 to prepare a coaxial cable according to the invention.

The coaxial cable thus obtained was evaluated for electric characteristics, that is, shield effect and attenuation level. The results are shown in Table 1 below.

Example 2

A coaxial cable was prepared in the same manner as in Example 1, except that a tape 4 with metal layers 8,8 provided respectively on both sides thereof as shown in FIG. 3B was used instead of the plastic tape 4 with a metal layer in Example 1. The coaxial cable thus obtained was evaluated in the same manner as in Example 1. The results are shown in Table 1.

Comparative Example 1

A coaxial cable was prepared in the same manner as in Example 1, except that the provision of the plastic tape 4 with a metal layer was omitted. The coaxial cable thus obtained was evaluated in the same manner as in Example 1. The results are shown in Table 1.

Comparative Example 2

A coaxial cable was prepared in the same manner as in Example 1, except that a plastic tape, with a metal layer, produced by vapor depositing copper to a thickness of 0.5 $\mu$m onto a 4 $\mu$m-thick polyester tape was used instead of the plastic tape 4 with a metal layer in Example 1. The coaxial cable thus obtained was evaluated in the same manner as in Example 1. The results are shown in Table 1.

TABLE 1

| Electric characteristics | | Unit | Comp. Ex. 1 | Comp. Ex. 2 | Ex. 1 | Ex. 2 |
|---|---|---|---|---|---|---|
| Shield effect at 0.1 to 1 GHz | | dB | 70 | 75 | 82 | 85 |
| Attenuation level | at 3 GHz | dB/m | 3.88 | 3.75 | 3.13 | 3.10 |
| | at 4 GHz | | 4.64 | 4.27 | 3.68 | 3.62 |
| | at 5 GHz | | 5.34 | 5.02 | 4.17 | 4.12 |
| | at 6 GHz | | 5.96 | 5.43 | 4.67 | 4.60 |

As is apparent from Table 1, for the shield effect, the conventional products prepared in Comparative Examples 1 and 2 were 70 dB and 75 dB, respectively, whereas both the coaxial cables of the invention prepared in Examples 1 and 2 were much greater than 80 dB and had excellent shield effect. Further, the attenuation level of the coaxial cables of Examples 1 and 2 according to the invention was lower at all the frequencies than that of the coaxial cables prepared in Comparative Examples 1 and 2.

As described above, according to the invention, a tape comprising an electroplating as a metal layer provided on the surface of a tape body has been adopted as the plastic tape with a metal layer to be provided on the insulation. By virtue of this construction, even when the outer diameter of the insulation is small, the tape can be easily and surely attached lengthwise to or wound on the circumference of the insulation and, at the same time, a satisfactory thickness of the metal layer can be ensured. Therefore, excellent effect can be attained including that a deterioration in electric characteristics attributable to the plastic tape with a metal layer can be surely avoided.

The invention has been described in detail with particular reference to preferred embodiments, but it will be understood that variations and modifications can be effected within the scope of the invention as set forth in the appended claims.

What is claimed is:

1. A coaxial cable comprising:

an inner conductor;

an insulation covering the inner conductor;

a plastic tape having a tape body and a metal layer provided on said insulation;

an outer conductor provided on said plastic tape; and a jacket provided on the outer conductor;

wherein the metal layer includes a first metal layer formed on said tape body by vapor deposition and a second metal layer formed on said first metal layer by electroplating, wherein the thickness of the metal layer forming the first and second metal layers of said plastic tape has a thickness of more than 1 $\mu$m and not more than 4 $\mu$m.

2. The coaxial cable according to claim 1, wherein the plastic tape with a metal layer is provided so that the surface of the metal layer is in contact with the outer conductor.

3. The coaxial cable according to claim 1, wherein the plastic tape with a metal layer is constructed so that the metal layer is provided on both sides of the tape body.

4. The coaxial cable according to claim 1, wherein the insulation has an outer diameter of not more than 1 mm.

5. The coaxial cable according to claim 1, wherein the outer conductor is formed of a braided material.

6. A coaxial multicore cable comprising: a plurality of coaxial cables of the type according to claim 1 which have been twisted together; and a sheath covering the circumference of the plurality of twisted coaxial cables.

* * * * *